US007266857B1

(12) United States Patent
Mezyed

(10) Patent No.: US 7,266,857 B1
(45) Date of Patent: Sep. 11, 2007

(54) FOOT SCRUBBING APPARATUS

(76) Inventor: Yosry N. Mezyed, 7810 W. 91st St., Hickory Hills, IL (US) 60457

( * ) Notice: Subject to any disclaimer, the term of this patent is extended or adjusted under 35 U.S.C. 154(b) by 263 days.

(21) Appl. No.: 11/120,481

(22) Filed: May 4, 2005

(51) Int. Cl.
*A47K 7/03* (2006.01)

(52) U.S. Cl. ..... 15/104.92; 15/244.1; 4/606

(58) Field of Classification Search ..... 15/104.92, 15/210.1, 244.1; 4/606
See application file for complete search history.

(56) References Cited

U.S. PATENT DOCUMENTS 3,543,747 A 12/1970 Gustafson
3,707,012 A * 12/1972 Lane ..... 15/104.93
5,163,200 A 11/1992 Carlin et al.
D343,476 S * 1/1994 Tomsick ..... D28/63
5,473,788 A 12/1995 Aragona
5,724,695 A 3/1998 Galizia
5,813,078 A 9/1998 Hogan, Sr.
D439,016 S 3/2001 Syran et al.
6,684,012 B2 * 1/2004 Kimura ..... 385/49
6,740,052 B1 * 5/2004 Regner ..... 601/136

* cited by examiner

*Primary Examiner*—Randall Chin

(57) ABSTRACT

A foot-scrubbing apparatus includes a non-porous and rigid base member that has planar top and bottom surfaces and suction cups permanently secured to the bottom surface. A primary sponge includes detachably engageable top and bottom layers defining a cavity therebetween for slidably receiving a user's entire foot. The top and bottom layers have vertically offset front edge portions for assisting the user to insert their foot into the cavity. A plurality of secondary sponges are directly conjoined to the top layer of the primary sponge and extend longitudinally therealong. The secondary sponges are sized and shaped such that a user's toes can be selectively nested between the secondary sponges. The secondary sponges have coarser surface textures than the primary sponge surface texture so that the user can clean tough skin surfaces adjacent to their toes.

14 Claims, 2 Drawing Sheets

FOOT SCRUBBING APPARATUS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to foot scrubbing apparatuses and, more particularly, to a foot scrubbing apparatus for promoting personal hygiene.

2. Prior Art

It is well known that difficulty and potential danger are involved with the manual washing of a person's own feet while taking a shower. Not only is it a chore to bend over to accomplish manual foot washing, but the act of doing so involves a balancing act on the other foot which is, at best, less than safe, and for some, potentially very dangerous. This is especially true for elderly individuals and those with debilitating back pain or other physical disabilities that prevent excessive bending of their backs. In spite of this, a person must nonetheless see to the proper hygiene of his or her feet, as they are frequently subject to becoming dirty and odoriferous, which may lead to fungal growths and other foot ailments that are costly and time consuming to cure.

In the prior art, there have been devised various devices for providing cleansing of the feet without the need for the person to bend over to perform washing by hand. These exemplary devices operate in one way or another on a brush principle for providing cleansing of the foot. While brushes can adequately perform a cleansing task on many surfaces, brushes tend to be harsh when applied to soft skin, such as that found on the top of a person's feet. Further, soap may not be well retained over a long term with respect to the bristles, especially in a shower environment of use.

Other foot scrubbing devices are adequate in their function but not in their design. These devices are complicated in design, thus raising the cost of production, and subsequently, the cost to the consumer, above an acceptable level.

Accordingly, a need remains for a foot scrubbing apparatus in order to overcome the above-noted shortcomings. The present invention satisfies such a need by providing a foot scrubbing apparatus that is convenient, easy and effective to use, light weight and practical in design, portable and attractive. Such an apparatus is ideal for back pain sufferers, the elderly and physically challenged individuals who may have difficulty bending over in the shower. The foot scrubbing apparatus effectively cleans feet and also removes dead skin cells and calluses, thus keeping the user's feet smooth, comfortable, attractive and healthy. Such a foot scrubbing apparatus is ideal for health-conscious individuals of all ages, and provides them with an instant pedicure in the privacy of their own home, saving them a considerable amount of money.

BRIEF SUMMARY OF THE INVENTION

In view of the foregoing background, it is therefore an object of the present invention to provide a foot scrubbing apparatus. These and other objects, features, and advantages of the invention are provided by a foot-scrubbing apparatus for promoting personal hygiene.

The apparatus includes a non-porous and rigid base member formed from non-corrosive and water-impermeable material. Such a base member has planar top and bottom surfaces.

A plurality of suction cups are directly and permanently secured to the bottom surface of the base member. Such suction cups are detachably engageable directly to a moist support surface so that the apparatus can effectively be maintained at a static position without requiring the user to bend over and hold the apparatus in place during operating conditions.

A primary sponge member includes detachably engageable top and bottom layers that define a cavity therebetween for effectively receiving a user's foot along a longitudinal axis of the apparatus. Such a cavity is sized and shaped such that the user's entire foot can advantageously be slidably inserted between the top and bottom layers while maintaining continuous surface area contact therewith and cleaning an entire surface area of the user's foot. The primary sponge member preferably has monolithically formed side walls for effectively preventing the top and bottom layers from becoming permanently disengaged from each other.

The top and bottom layers have vertically offset front edge portions for conveniently assisting the user to insert the user's foot into the cavity during repeated use. The front edge of the top layer may be distally recessed from the front edge of the bottom layer for conveniently assisting the user to cleanse a heel portion of the user's foot during operating conditions. The primary sponge member may be provided with a plurality of apertures spaced along the top layer that pass downwardly to the cavity for conveniently impregnating a cleansing agent directly through the top layer and onto the bottom layer of the primary sponge member.

A plurality of secondary sponge members are directly conjoined to the top layer of the primary sponge member and longitudinally extend along a partial length of the top layer. Such secondary sponge members are sized and shaped such that a user's toes can effectively be selectively nested between the secondary sponge members during a linear and longitudinal sliding movement along the top layer. The secondary sponge members have surface textures which are coarser than a surface texture of the primary sponge member so that the user can effectively clean tough skin surfaces adjacent to the user's toes. The bottom layer preferably includes an arcuate shaped top portion that is coarser than a remaining portion of the primary sponge material. Such a top portion extends proximally from the front edge of the top layer.

The secondary sponge members may be coextensively shaped and include monolithically formed top, side and bottom portions directly secured to the top layer. Such top portions have rectilinear shapes extending distally from a front edge of the top layer. The side portions have rectilinear shapes extending downwardly along the front edge of the top layer. The bottom portions extend distally from the front edge of the top layer such that the user's toes may be selectively intercalated between the secondary sponge members by rubbing the user's foot along either the top layer or between the top and bottom layers respectively.

In an alternate embodiment, a pumice stone may be directly connected to the base member and provided with a top surface laterally offset subjacent the top layer so that the user can advantageously quickly and effectively rub a bottom surface of the user's foot along the pumice stone without directly contacting the primary and secondary sponge members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures and prime numbers refers to alternate embodiments of such elements.

Figure 1:
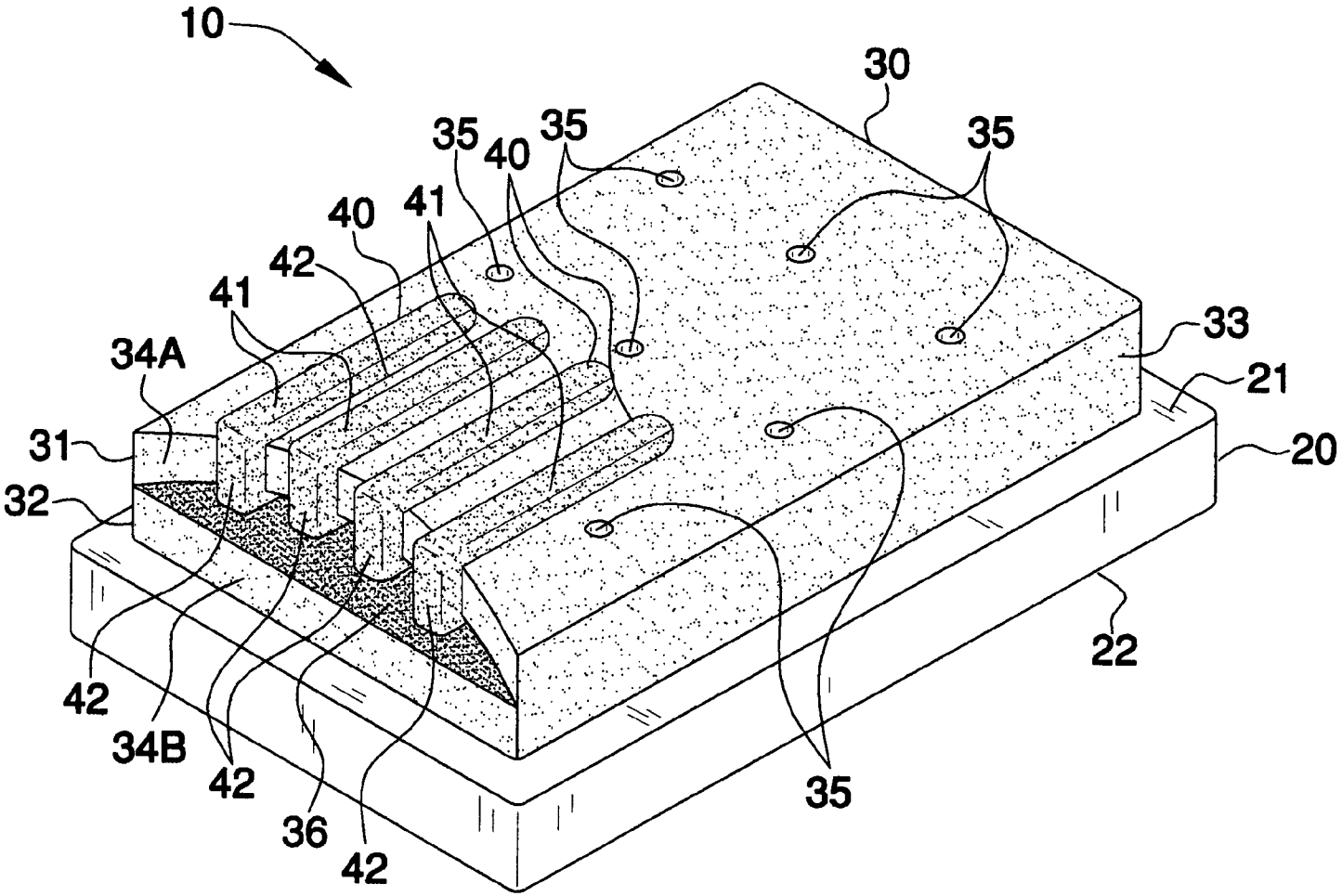
FIG. 1 is a perspective view showing a foot scrubbing apparatus, in accordance with the present invention.
Figure 2:
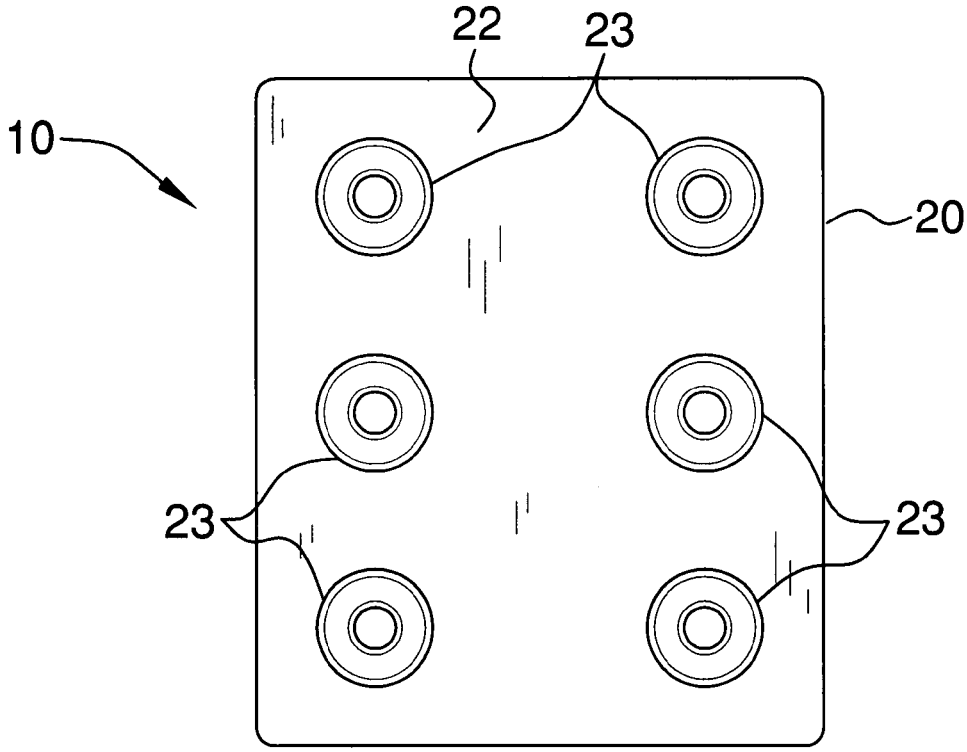
FIG. 2 is a bottom plan view of the apparatus shown in FIG. 1, showing the plurality of suction cups.
Figure 3:
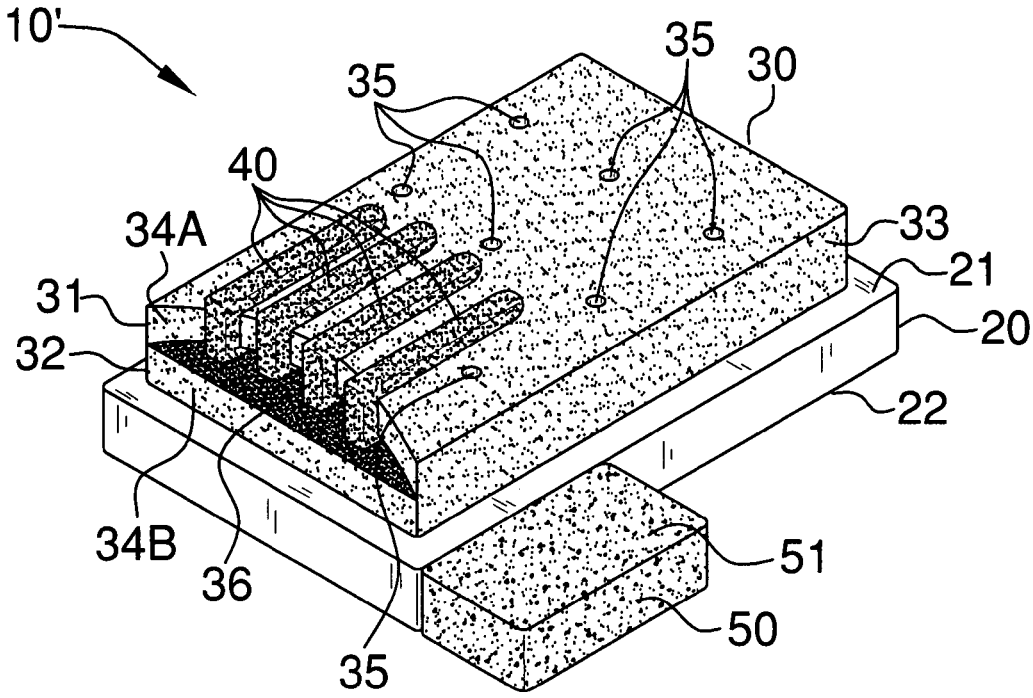
FIG. 3 is perspective view showing an alternate embodiment of the apparatus shown in FIG. 1, with a pumice stone attached thereto.

The apparatus of this invention is referred to generally in FIGS. 1-3 by the reference numeral 10 and is intended to provide a foot scrubbing apparatus. It should be understood that the apparatus 10 may be used to scrub many different appendages of both humans and animals, and should not be limited in use to only scrubbing one's feet in the shower.

Referring initially to FIGS. 1 and 2, the apparatus 10 includes a non-porous and rigid base member 20 formed from non-corrosive and water-impermeable material. Such a base member 20 has planar top 21 and bottom 22 surfaces.

Referring to FIG. 2, a plurality of suction cups 23 are directly and permanently secured, with no intervening elements, to the bottom surface 22 of the base member 20. The suction cups 23 conveniently allow an individual to use both of their hands to more effectively stabilize themselves during operating conditions. Such suction cups 23 are detachably engageable directly to a moist support surface, which is essential so that the apparatus 10 can effectively be maintained at a static position without requiring the user to bend over and hold the apparatus 10 in place during operating conditions. This feature makes the apparatus 10 especially appealing to the elderly and those suffering from physical disabilities that limit their back bending capabilities. Of course, alternate slip preventative measures may be employed, such as a non slip material attached to the bottom surface 22, as is obvious to a person of ordinary skill in the art.

Referring to FIGS. 1 and 3, a primary sponge member 30 includes detachably engageable top 31 and bottom 32 layers that define a cavity therebetween that is critical for effectively receiving a user's foot along a longitudinal axis of the apparatus 10. Such a cavity is sized and shaped such that the user's entire foot can advantageously be slidably inserted between the top 31 and bottom 32 layers while maintaining continuous surface area contact therewith and cleaning an entire surface area of the user's foot. The primary sponge member 30 has monolithically formed side walls 33 for effectively preventing the top 31 and bottom 32 layers from becoming permanently disengaged from each other, which would render the apparatus 10 less effective.

Still referring to FIGS. 1 and 3, the top 31 and bottom 32 layers have vertically offset front edge portions 34 that are important and convenient for assisting the user to insert their foot into the cavity during repeated use. The front edge 34A of the top layer 31 is distally recessed from the front edge 34B of the bottom layer 32 for conveniently assisting the user to cleanse a heel portion of the user's foot during operating conditions. The primary sponge member 30 is provided with a plurality of apertures 35 spaced along the top layer 31 that pass downwardly to the cavity and are vital for conveniently impregnating a cleansing agent directly through the top layer 31 and onto the bottom layer 32 of the primary sponge member 30. The bottom layer 32 includes an arcuate shaped top portion 36 that is coarser than a remaining portion of the primary sponge material 30. Such a top portion 36 extends proximally from the front edge 34A of the top layer 31, and is crucial and advantageous for more effectively cleaning the generally tougher skin on the bottom of one's feet.

Again referring to FIGS. 1 and 3, a plurality of secondary sponge members 40 are directly conjoined, with no intervening elements, to the top layer 31 of the primary sponge member 30 and longitudinally extend along a partial length of the top layer 31. Such secondary sponge members 40 are sized and shaped such that a user's toes can effectively be selectively nested between the secondary sponge members 40 during a linear and longitudinal sliding movement along the top layer 31. This allows for cleaning of the area between a person's toes which is so often neglected during normal washing and bathing and leads to odorous feet, thus improving the user's overall hygiene. The secondary sponge members 40 have surface textures which are coarser than a surface texture of the primary sponge member 30 so that the user can effectively clean tough skin surfaces adjacent to the user's toes.

Referring yet again to FIGS. 1 and 3, the secondary sponge members 40 are coextensively shaped and include monolithically formed top 41, side 42 and bottom (not shown) portions directly secured, with no intervening elements, to the top layer 31. Such top portions 41 have rectilinear shapes extending distally from a front edge 34A of the top layer 31. The side portions 42 have rectilinear shapes extending downwardly along the front edge 34A of the top layer 31. The bottom portions extend distally from the front edge 34A of the top layer 31 such that the user's toes may be selectively intercalated between the secondary sponge members 40 by rubbing the user's foot along either the top layer 31 or between the top 31 and bottom 32 layers respectively.

Referring to FIG. 3, in an alternate embodiment 10', a pumice stone 50 is directly connected, with no intervening elements, to the base member 20 and provided with a top surface 51 laterally offset subjacent the top layer 31 so that the user can advantageously quickly and effectively rub a bottom surface of the user's foot along the pumice stone 50 without directly contacting the primary 30 and secondary 40 sponge members.

While the invention has been described with respect to a certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A foot-scrubbing apparatus for promoting personal hygiene, said apparatus comprising:

a non-porous and rigid base member formed from non-corrosive and water-impermeable material, said base member having planar top and bottom surfaces;

a plurality of suction cups directly and permanently secured to said bottom surface of said base member, said suction cups being detachably engageable directly to a moist support surface so that said apparatus can be maintained at a static position without requiring the user to bend over and hold said apparatus in place during operating conditions;

a primary sponge member including detachably engageable top and bottom layers defining a cavity therebetween for receiving a user's foot along a longitudinal axis of said apparatus, the cavity being sized and shaped such that the user's entire foot can be slidably inserted between said top and bottom layers while maintaining continuous surface area contact therewith and cleaning an entire surface area of the user's foot, said top and bottom layers having vertically offset front edge portions for assisting the user to insert the user's foot into the cavity during repeated use; and a plurality of secondary sponge members directly conjoined to said top layer of said primary sponge member and longitudinally extending along a partial length of said top layer, said secondary sponge members being sized and shaped such that a user's toes can be selectively nested between said secondary sponge members during a linear and longitudinal sliding movement along said top layer.

2. The apparatus of claim 1, wherein said primary sponge member is provided with a plurality of apertures spaced along said top layer and passing downwardly to the cavity for impregnating a cleansing agent directly through said top layer and onto said bottom layer of said primary sponge member.

3. The apparatus of claim 1, wherein said secondary sponge members are coextensively shaped and include monolithically formed top, side and bottom portions directly secured to said top layer, said top portions having rectilinear shapes extending distally from a front edge of said top layer, said side portions having rectilinear shapes extending downwardly along said front edge of said top layer, said bottom portions extending distally from said front edge of said top layer such that the user's toes may be selectively intercalated between said secondary sponge members by rubbing the user's foot along either said top layer or between said top and bottom layers respectively.

4. The apparatus of claim 1, wherein said bottom layer comprises: an arcuate shaped top portion that is coarser than a remaining portion of said primary sponge member, said top portion extending proximally from said front edge of said top layer.

5. The apparatus of claim 1, wherein said front edge of said top layer is distally recessed from said front edge of said bottom layer for assisting the user to cleanse a heel portion of the user's foot during operating conditions.

6. The apparatus of claim 1, wherein said primary sponge member has monolithically formed side walls for preventing said top and bottom layers from becoming permanently disengaged from each other.

7. The apparatus of claim 1, further comprising: a pumice stone directly connected to said base member and provided with a top surface laterally offset subjacent said top layer so that the user can quickly and effectively rub a bottom surface of the user's foot along said pumice stone without directly contacting said primary and secondary sponge members.

8. A foot-scrubbing apparatus for promoting personal hygiene, said apparatus comprising:

a non-porous and rigid base member formed from non-corrosive and water-impermeable material, said base member having planar top and bottom surfaces;

a plurality of suction cups directly and permanently secured to said bottom surface of said base member, said suction cups being detachably engageable directly to a moist support surface so that said apparatus can be maintained at a static position without requiring the user to bend over and hold said apparatus in place during operating conditions;

a primary sponge member including detachably engageable top and bottom layers defining a cavity therebetween for receiving a user's foot along a longitudinal axis of said apparatus, the cavity being sized and shaped such that the user's entire foot can be slidably inserted between said top and bottom layers while maintaining continuous surface area contact therewith and cleaning an entire surface area of the user's foot, said top and bottom layers having vertically offset front edge portions for assisting the user to insert the user's foot into the cavity during repeated use;

a plurality of secondary sponge members directly conjoined to said top layer of said primary sponge member and longitudinally extending along a partial length of said top layer, said secondary sponge members being sized and shaped such that a user's toes can be selectively nested between said secondary sponge members during a linear and longitudinal sliding movement along said top layer; and wherein said secondary sponge members have surface textures which are more coarse than a surface texture of said primary sponge member so that the user can effectively clean tough skin surfaces adjacent the user's toes.

9. The apparatus of claim 8, further comprising: a pumice stone directly connected to said base member and provided with a top surface laterally offset subjacent said top layer so that the user can quickly and effectively rub a bottom surface of the user's foot along said pumice stone without directly contacting said primary and secondary sponge members.

10. The apparatus of claim 8, wherein said primary sponge member is provided with a plurality of apertures spaced along said top layer and passing downwardly to the cavity for impregnating a cleansing agent directly through said top layer and onto said bottom layer of said primary sponge member.

11. The apparatus of claim 8, wherein said secondary sponge members are coextensively shaped and include monolithically formed top, side and bottom portions directly secured to said top layer, said top portions having rectilinear shapes extending distally from a front edge of said top layer, said side portions having rectilinear shapes extending downwardly along said front edge of said top layer, said bottom portions extending distally from said front edge of said top layer such that the user's toes may be selectively intercalated between said secondary sponge members by rubbing the user's foot along either said top layer or between said top and bottom layers respectively.

12. The apparatus of claim 8, wherein said bottom layer comprises: an arcuate shaped top portion that is coarser than a remaining portion of said primary sponge member, said top portion extending proximally from said front edge of said top layer.

13. The apparatus of claim 8, wherein said front edge of said top layer is distally recessed from said front edge of said bottom layer for assisting the user to cleanse a heel portion of the user's foot during operating conditions.

14. The apparatus of claim 8, wherein said primary sponge member has monolithically formed side walls for preventing said top and bottom layers from becoming permanently disengaged from each other.

* * * * *